US010816301B1

(12) United States Patent
Özenser

(10) Patent No.: US 10,816,301 B1
(45) Date of Patent: Oct. 27, 2020

(54) BLANK FIRING RIFLE

(71) Applicant: AKSA SILAH INSAAT METAL SANAYI TICARET LIMITED SIRKETI, Konya (TR)

(72) Inventor: Hüseyin Özenser, Konya (TR)

( * ) Notice: Subject to any disclaimer, the term of this patent is extended or adjusted under 35 U.S.C. 154(b) by 0 days.

(21) Appl. No.: 16/850,179

(22) Filed: Apr. 16, 2020

(30) Foreign Application Priority Data

Apr. 19, 2019 (TR) ..... 2019/05875

(51) Int. Cl.
*F41A 33/04* (2006.01)

(52) U.S. Cl.
CPC ..... *F41A 33/04* (2013.01)

(58) Field of Classification Search
CPC ..... F41A 33/04
See application file for complete search history.

(56) References Cited

U.S. PATENT DOCUMENTS

| | | | | |
|---|---|---|---|---|
| 7,926,405 | B2 * | 4/2011 | Ducastel, Jr. | F41A 21/26 89/29 |
| 9,303,938 | B2 * | 4/2016 | Hiscock | F41A 21/26 |
| 9,593,911 | B2 * | 3/2017 | Jones | F41A 33/02 |
| 9,777,981 | B1 * | 10/2017 | Bower | F41A 33/04 |
| 10,054,390 | B1 * | 8/2018 | Hane | F41A 5/02 |

FOREIGN PATENT DOCUMENTS

TR 201819706 U5 1/2019

* cited by examiner

*Primary Examiner* — Reginald S Tillman, Jr.
(74) *Attorney, Agent, or Firm* — Egbert Law Offices, PLLC

(57) ABSTRACT

A blank firing rifle provides a real firearm appearance and real gunshot sounds to firearms used while shooting gunfight, shootout and battle scenes in all fields and areas needed, particularly in the cinema industry.

3 Claims, 3 Drawing Sheets

BLANK FIRING RIFLE

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to a blank firing rifle that provides a real firearm appearance and real gunshot sounds to firearms used while shooting gunfight, shootout and battle scenes in all fields and areas needed, particularly in the cinema industry.

2. Description of Related Art Including Information Disclosed Under 37 CFR 1.97 And 37 CFR 1.98

Nowadays, blank firing pistols that feature no killing or wounding functions and fire only by making gunshot sounds are commonly available in the market. Said pistols are widely used for various purposes and in many different fields such as while shooting movies in the motion picture industry, or by citizens to scare away wild animals or discourage a potential assailant in the event of danger. Rounds used in blank firing pistols feature different sizes and weights and the internal components of the pistol (mechanism, barrel, magazine, etc.) are designed accordingly.

Nowadays, even though blank firing pistols are used widely, there are no rifles (having mechanism, magazine, and barrel compatible with blank rounds) available that are capable of shooting blanks directly. In the state of the art, rendering a rifled or smoothbore firearm to fire blank rounds may be possible by attaching an additional apparatus to a firearm or by making changes in the internal components thereof. In respect thereof, a study was carried out by us in the Turkish utility model application numbered "2018/19706" and titled "Apparatus That Allows for Firing Blank Rounds by Rifled and Smooth Bore Guns". In the aforementioned study, an apparatus called a cartridge is installed to the rifle that fires normal rounds, thereby rendering it capable of firing blank rounds. However, a disadvantage of this study is that the rifle is rendered capable of firing real rounds once the cartridge apparatus is removed by the user.

In the state of the art, replicas are predominantly used when shooting battle and gunfight scenes in the cinema industry. The actor who is holding the rifle as part of the act pretends that he/she is shooting, and the gunshot sounds along with the explosion effect are subsequently created by means of a computer. The actor who is holding a replica while acting cannot fully focus on his/her role, thereby failing to give the desired sense of reality as he/she cannot hear the real gunshot sound, nor he/she can feel the weight of a real firearm. Furthermore, images and footage generated by a computer not only require high technology for producers but also bring major additional costs.

Another technique implemented in the state of the art involves using real firearms without ammunition in movie scenes. However, many of these scenes look unprofessional and even amateurish for the motion picture industry that is followed by thousands of people. On the other hand, producers are constrained to utilize incendiary ammunition to provide a sense of reality in movie sets where real rifles are used. Quite naturally, this poses major obstacles in terms of the law and may potentially lead to accidents involving injuries or even death as the firearms are not handled by trained professionals.

In general, blank rounds may be fired by commercially available rifles. However, these do not feature 9 mm gauge (blank round gauge), and since rounds fired by real hunting rifles are measured by calibers (12, 20, 36, etc.), there may be gaps inside the barrel. Accordingly, this may cause accidents involving injuries or even death, since the barrel, magazine, and mechanisms of real hunting rifles are designed for firing live ammunition. Moreover, this type of firearms is capable of firing single shots and accordingly does not allow the user to fire burst or semi-automatic shots.

Consequently, the existence of the aforementioned problems in the state of the art and the inefficacy of the available solutions necessitated making an improvement in the art related to rifles capable of firing blank rounds.

BRIEF SUMMARY OF THE INVENTION

The present invention relates to a blank firing rifle that meets all the aforementioned requirements, eliminates all disadvantages and provides further advantages.

The main object of the present invention is to provide a blank firing rifle that provides a real firearm appearance and real gunshot sounds to firearms used while shooting gunfight, shootout and battle scenes in all fields and areas needed, particularly in the cinema industry.

Another object of the present invention is to provide a rifle that is capable of firing only blank rounds by redesigning the magazine, mechanism, and barrel of a standard rifle that fires live ammunition. The inventive rifle allows for firing blank rounds (9 mm) only and no live ammunition of any caliber having a bullet on the end thereof may be fired due to the mechanism, barrel and magazine designs of the rifle.

By designing the inventive rifle that fires only blank rounds, it is further aimed to:

- primarily minimize the risks for injuries and accidents occurring in movie sets;
- ensure that the rifle is not wounding nor deadly by providing a rifle that is capable of firing blank rounds only and that cannot fire any live ammunition even though the actor is inexperienced;
- ensure that the inventive rifle provides a sense of reality without the aid of the visual effects used in gunfight and battle scenes; and
- ensure that sound effects are consonant with events occurring in a scene and provide real sound and light quality (preventing asynchrony between the frame and the sound).

REFERENCE NUMERALS

A. Blank Firing Rifle
- 10. Magazine
  - 11. Ejector
  - 12. Chamber
  - 13. Blank Round
- 20. Mechanism
  - 21. Body
  - 22. Bolt
  - 23. Tab
  - 24. Round Tray
- 30. Barrel
  - 31. Cap
  - 32. Inner Barrel-a
  - 33. Inner Barrel-b Figures do not necessarily have to be scaled, and redundant details that are not required for understanding the present invention may be omitted. Additionally, components that are at least substantially identical or at least have substantially identical functions are indicated with the same number.

DETAILED DESCRIPTION OF THE INVENTION

In the detailed description provided herein, preferred embodiments of the inventive blank firing rifle (A) are disclosed so as to ensure a better understanding of the subject and without creating any limiting effects.

In order to ensure that the inventive blank firing rifle (A) is capable of firing blank rounds (9 mm) only, the magazine (10), the mechanism (20) and the barrel (30) portions thereof are designed differently from the conventional rifles.

Figure 1:
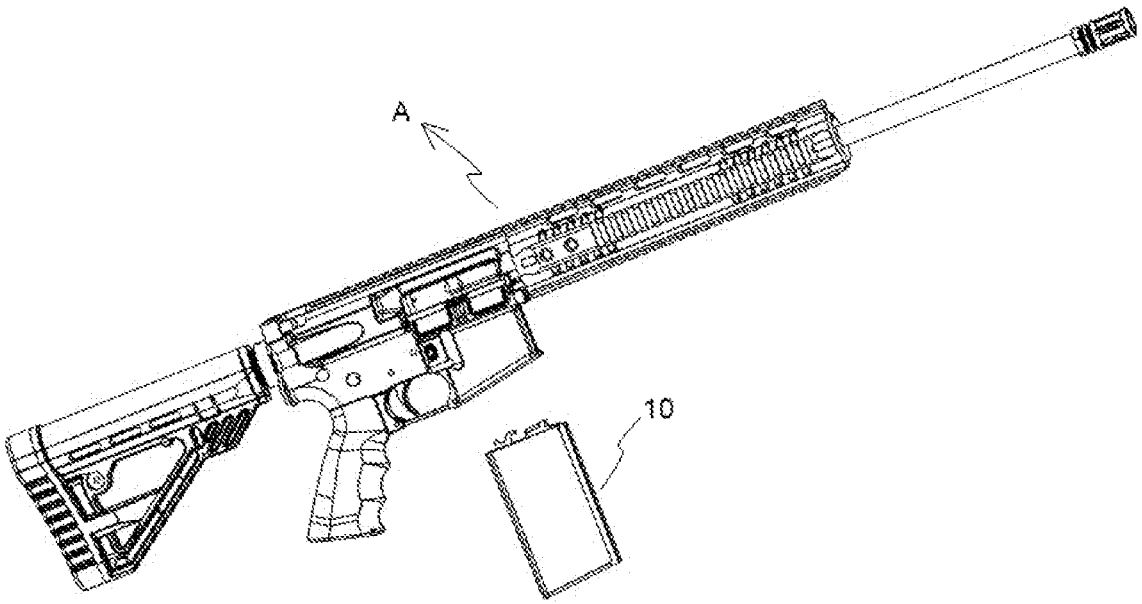
FIG. 1 illustrates the general perspective view of the inventive blank firing rifle.
Figure 2:
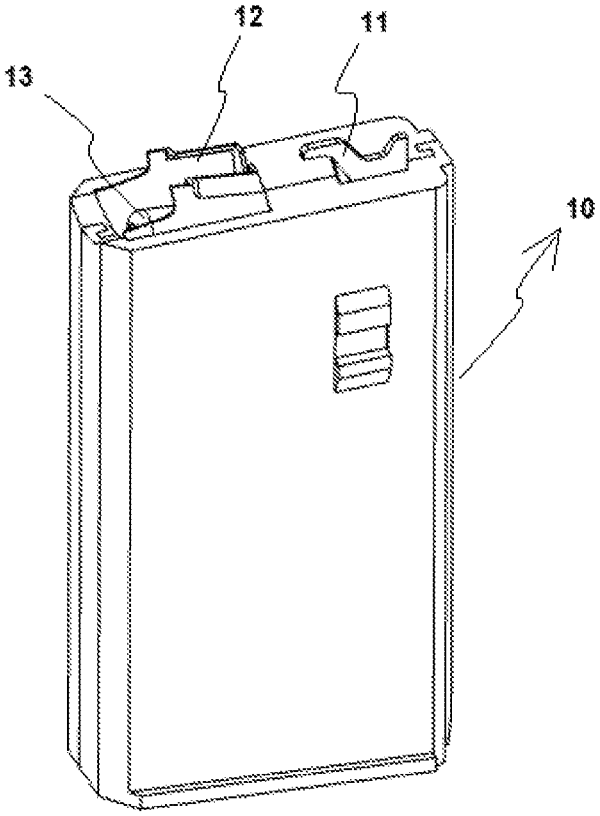
FIG. 2 illustrates the general view of the magazine of the inventive blank firing rifle, wherein said the magazine is designed so as to be compatible with blank rounds.

FIG. 2 illustrates the general view of the magazine of the inventive blank firing rifle (A), wherein said magazine (10) is designed so as to be compatible with blank rounds (13). An ejector (11) is position on said magazine (10) so as to eject the empty rounds from the rifle. Said ejector (11) allows for drawing the empty case backward by means of the tab (23) located on the mechanism (20) subsequent to firing a shot, and the empty case hits the ejector (11) while being drawn, and gets ejected through the ejection port located on the upper body of the rifle. The chamber (12) that allows for loading the magazine (20) with blank rounds (13) and for feeding a single round to the barrel rest for every shot, is limited to 9 mm blank round (13) dimensions, therefore no live ammunition of any caliber may be loaded.

Figure 3:
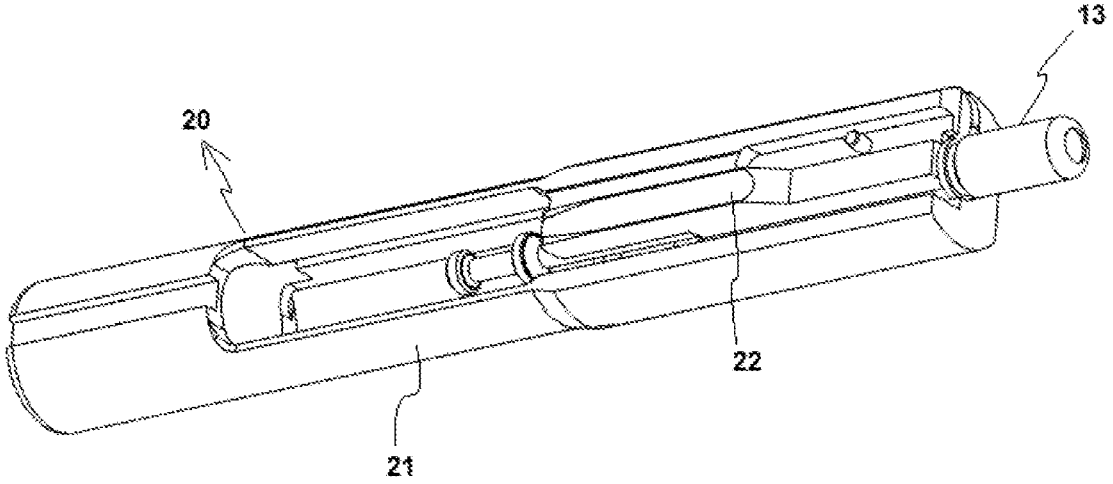
FIG. 3 illustrates the general view of the mechanism of the inventive blank firing rifle, wherein said mechanism is designed so as to be compatible with blank rounds.
Figure 4:
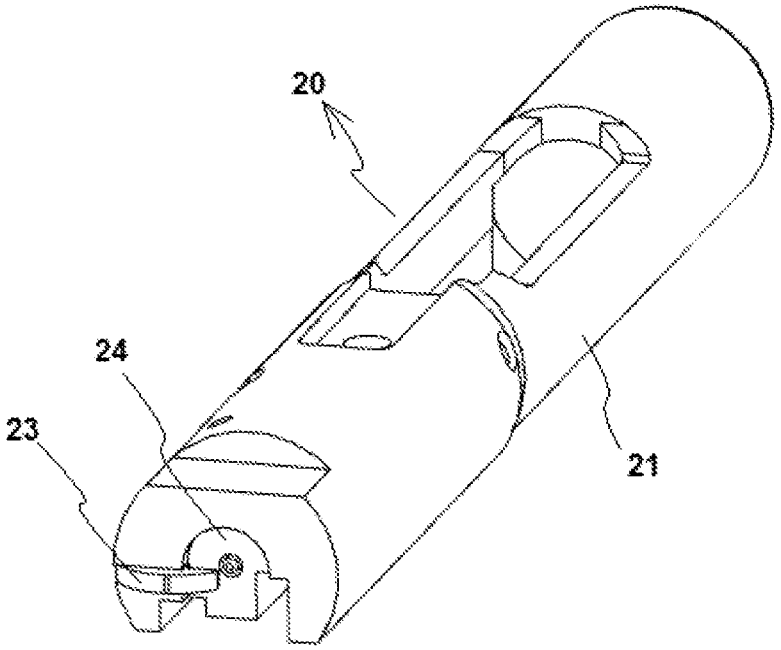
FIG. 4 illustrates a further view of the mechanism of the inventive blank firing rifle, wherein said mechanism is designed so as to be compatible with blank rounds.

FIG. 3 and FIG. 4 illustrate the views of mechanism (20) of the inventive blank firing rifle (A) wherein said mechanism (20) is designed so as to accommodate blank rounds (13). Said mechanism comprises a main body (21) having all components located thereon. Empty cases are removed from the barrel by means of the tab (23) located on said body (21). Two channels are located at the lower portion of the main body (21). A bolt (22) is positioned in the midsection of these channels, wherein said bolt pushes the ammunition into the firing chamber. Dimensions of said bolt (22) are also limited in compliance with the dimensions of blank round (13). Analogously, dimensions of the round tray (24) to which the blank round leans against on the main body (21) also limited in compliance with the dimensions of blank rounds (13).

Figure 5:
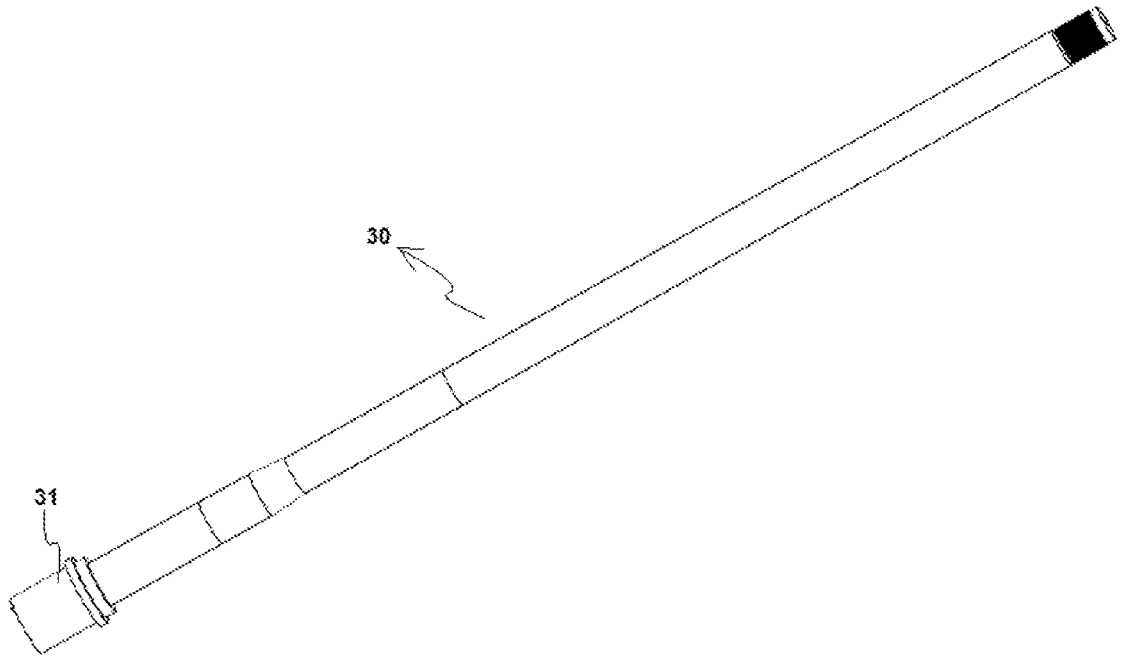
FIG. 5 illustrates the general view of the barrel of the inventive blank firing rifle, wherein said barrel is designed so as to be compatible with blank rounds.
Figure 6:
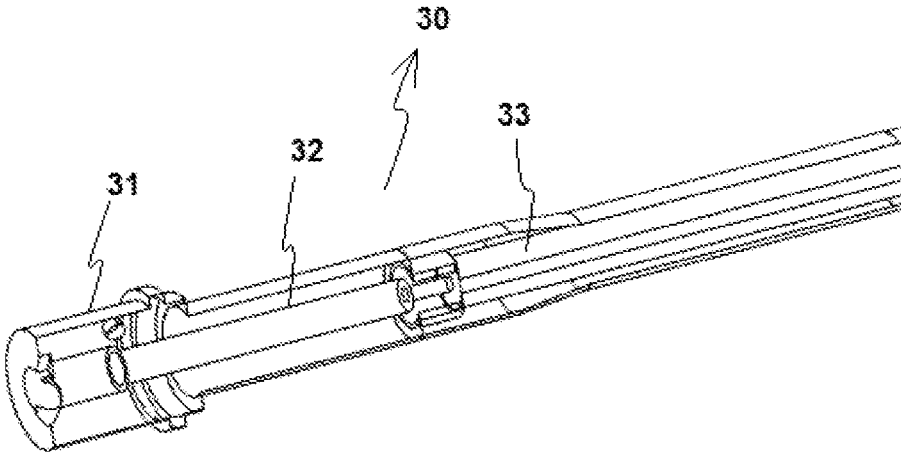
FIG. 6 illustrates the detailed view of the barrel of the inventive blank firing rifle, wherein said barrel is designed so as to be compatible with blank rounds.

FIG. 5 and FIG. 6 illustrate the general and detailed views of the barrel (30) of the inventive blank firing rifle (A), wherein said barrel is designed so as to be compatible with blank rounds (13). A structure called adjacent cap (31) is formed with the barrel (30) so as to connect the barrel (30) to the mechanism (20). Inner portion of said barrel (30) is designed to feature two different diameters as the inner barrel-a (32) and the inner barrel-b (33). The diameter of the inner barrel-a (32) that is closer to the cap (31) side, i.e. to the mechanism (20), is designed to allow for firing blank rounds (13) only, and it is smaller than the diameter of the inner barrel-b (33). Only blank rounds (13) having a diameter of 9 mm may pass through the inner barrel-a (32).

I claim:

1. A blank firing rifle that provides a real firearm experience and a real gunshot sound, the blank firing rifle comprising:

a magazine having a chamber adapted to receive a blank round of no more than 9 millimeters therein, said magazine having an ejector cooperative with the chamber and adapted to eject an empty case of the blank round subsequent to the firing of the blank round;

a mechanism having a main body and a bolt and a round tray formed in a mid-section of a pair of channels at a lower portion of the main body and adapted to push the blank round into the chamber of said magazine; and a barrel having a first inner barrel and a second inner barrel, the first inner barrel having a diameter that is different than a diameter of the second inner barrel, the first inner barrel positioned closer to said mechanism than the second inner barrel.

2. The blank firing rifle of claim 1, wherein an inner diameter of the first inner barrel is less than an inner diameter of the second inner barrel.

3. The black firing rifle of claim 1, further comprising:

a cap connecting said barrel to said mechanism.

* * * * *